United States Patent [19]

Mellin

[11] 4,290,243

[45] Sep. 22, 1981

[54] BUILDING MEMBRANE HOLD-DOWN SYSTEM

[75] Inventor: Gerald D. Mellin, Bradenton, Fla.

[73] Assignee: Seaman Corporation, Sarasota, Fla.

[21] Appl. No.: 134,486

[22] Filed: Mar. 27, 1980

[51] Int. Cl.[3] ..... E04B 1/347; E04B 1/00

[52] U.S. Cl. ..... 52/63; 52/222; 135/15 CF

[58] Field of Search ..... 52/63, 222; 135/1 R, 135/15 CF; 403/314, 367, 374, 409

[56] References Cited

U.S. PATENT DOCUMENTS

| | | | |
|---|---|---|---|
| 2,988,795 | 6/1961 | French | 403/314 |
| 3,374,797 | 3/1968 | Neumark | 135/15 CF |
| 3,872,634 | 3/1975 | Seaman | 52/63 X |
| 3,960,461 | 6/1976 | Sachs | 403/374 X |
| 3,965,544 | 6/1976 | Boden | 403/374 X |
| 4,096,669 | 6/1978 | Pabst | 52/63 |

*Primary Examiner*—J. Karl Bell

*Attorney, Agent, or Firm*—Hamilton, Renner & Kenner

[57] ABSTRACT

A hold-down system for a membrane (10) covering a rigid framework and having catenary cables (11 and 12) secured to the bottom edges of said membrane between bays, said system having a retainer sleeve (19) comprising spaced-apart plates (21) connected by inclined side bars (22) and a wedge-shaped keeper plate slidable therein to wedgably hold overlapping loops (11' and 12') of the end portions of two contiguous cables (11 and 12) and flexible linear means (16) detachably connecting said keeper plate to a foundation anchor (15).

6 Claims, 5 Drawing Figures

2/2
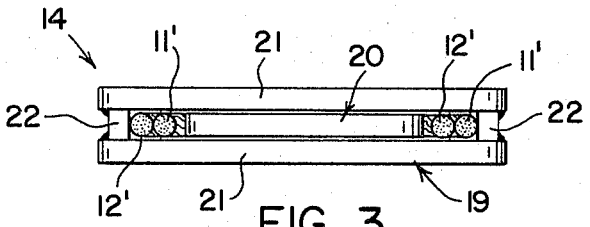
FIG. 3
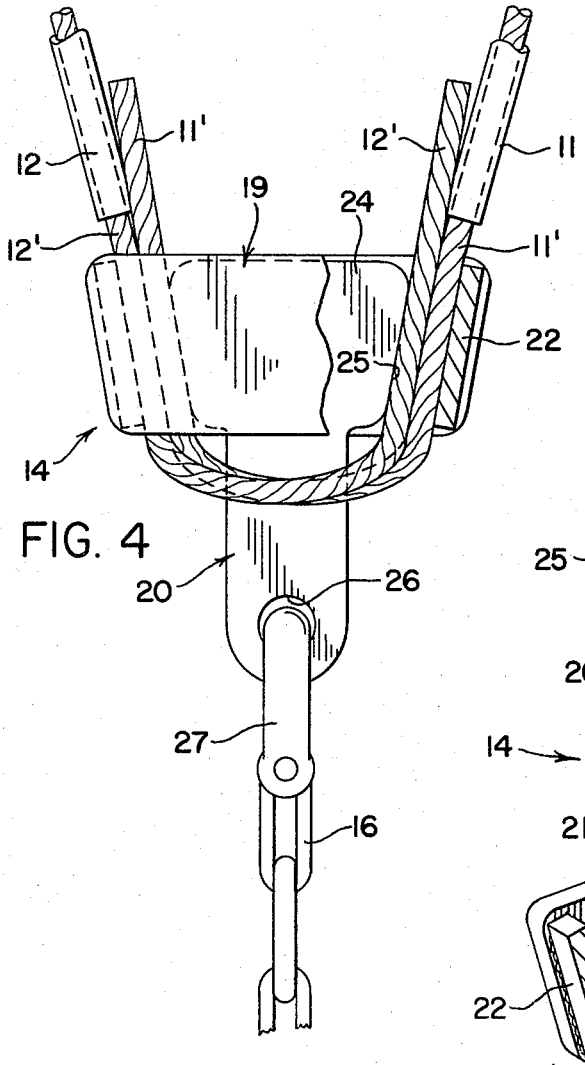
FIG. 4
FIG. 5
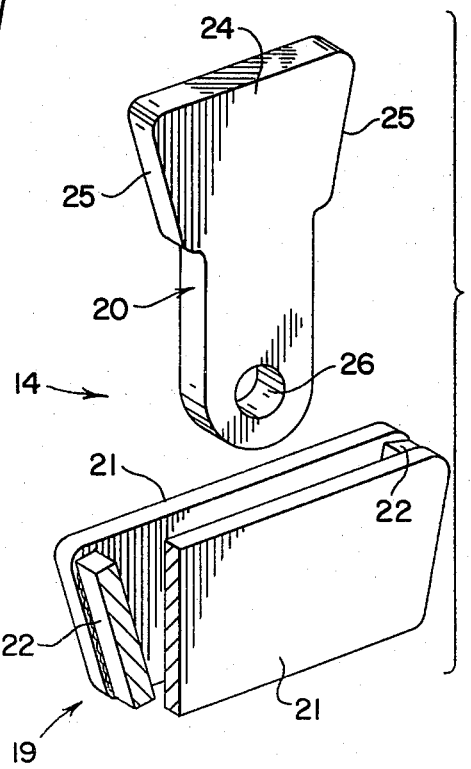

BUILDING MEMBRANE HOLD-DOWN SYSTEM

TECHNICAL FIELD

Structures having flexible membrane coverings tensioned by cables extending along the lower edges and anchored at intervals to the foundation for the structure.

BACKGROUND ART

U.S. Pat. No. 3,872,634, issued Mar. 25, 1975, discloses a rigid framework having spaced trusses and a unitary membrane covering the framework with catenary cables in the lower edges of the membrane between trusses having their ends anchored to the foundation or to the trusses supported thereon. U.S. Pat. Nos. 3,973,364 and 4,096,669 disclose similar structures with membrane segments covering the bays between and connected to the trusses, and the lower edges of the segments held down by catenary cables anchored at their ends to the trusses or the foundation.

In each of these prior constructions the ends of two adjoining catenary cables are snubbed through and clamped by crosby clips to a multi-loop tensioning connector which is in turn adjustably connected to a truss at the foundation. The connecting assembly is relatively complicated and expensive in that it involves the specially formed tensioning connector, at least two crosby clips and a specially designed adjustable connector. Moreover, the crosby clips and cable ends tend to rub against the wear holes in the membrane curtains which are used to close the curved bottom openings formed below the catenary cables along the bottom edges of the main covering.

SUMMARY OF THE INVENTION

The present invention provides a simple and inexpensive hold-down system for the adjacent ends of two adjacent catenary cables for the purpose of tensioning a membrane covering over a structure.

An object of the invention is to provide a connection system with a minimum number of parts which is adapted to connect the cable ends to a foundation anchor.

Another object is to provide a simple connection system which is adapted to connect the cable ends to an anchor in a minimum amount of time and without special tools.

A further object is to provide a simple and inexpensive connection system which protects the closure curtains depending from the bottom curved edges of the main membrane covering from damage by engagement with rough or sharp edges of the cables or connection means.

These and other objects are accomplished by the improvements comprising the present invention, a preferred embodiment of which is disclosed and described herein as exemplifying the best known mode of carrying out the invention. Various modifications and details of construction are comprehended within the scope of the appended claims.

BRIEF DESCRIPTION OF DRAWINGS

FIG. 3 is a further enlarged partial sectional view on line 3—3 of FIG. 1.

FIG. 4 is an enlarged partial view similar to FIG. 1, partly broken away and in section.

FIG. 5 is an exploded perspective view of the detached cable retainer, partly broken away and in section.

PREFERRED EMBODIMENT OF THE INVENTION

Figure 1:
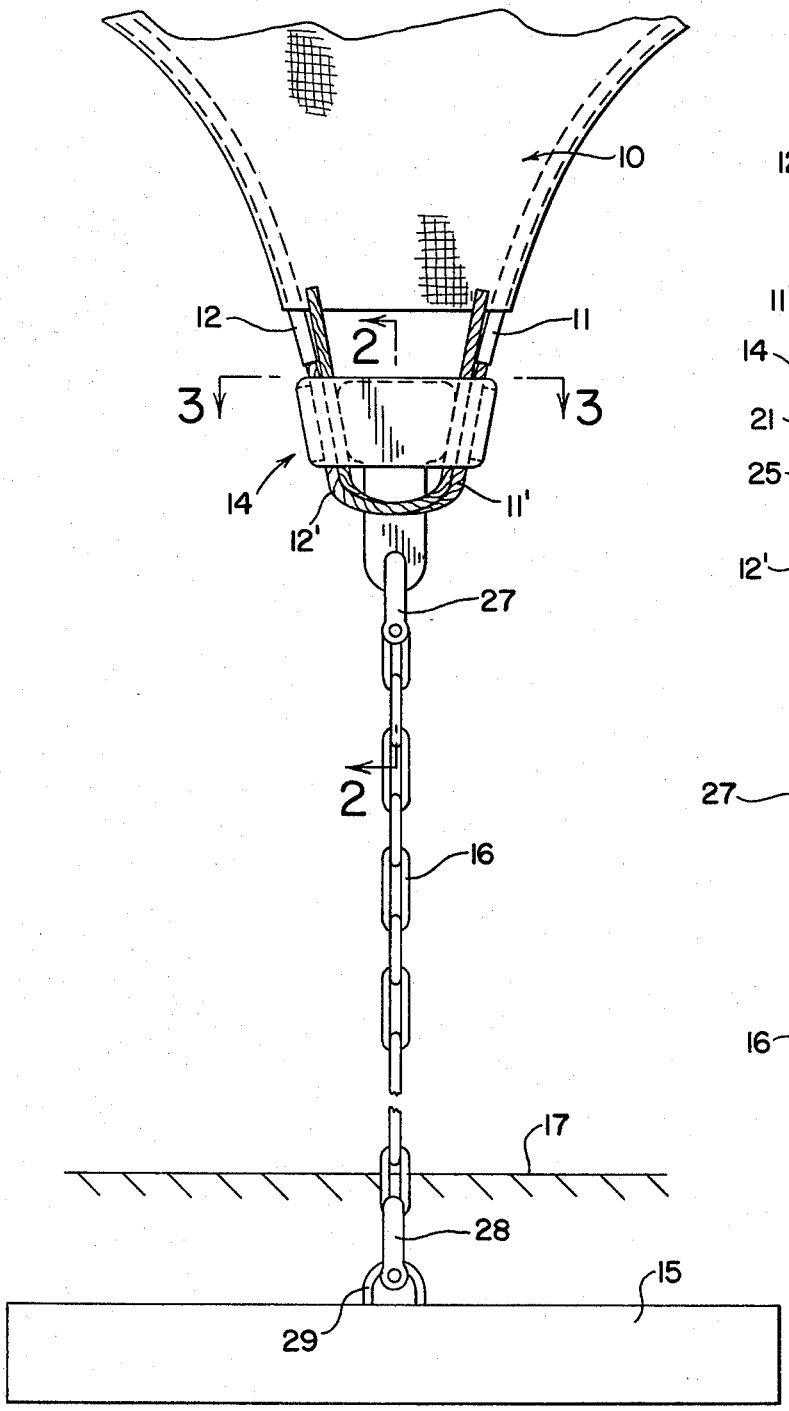
FIG. 1 is a fragmentary elevation showing the improved hold-down system applied to two contiguous catenary cables in the lower edges of a membrane covering for a rigid framework.
Figure 2:
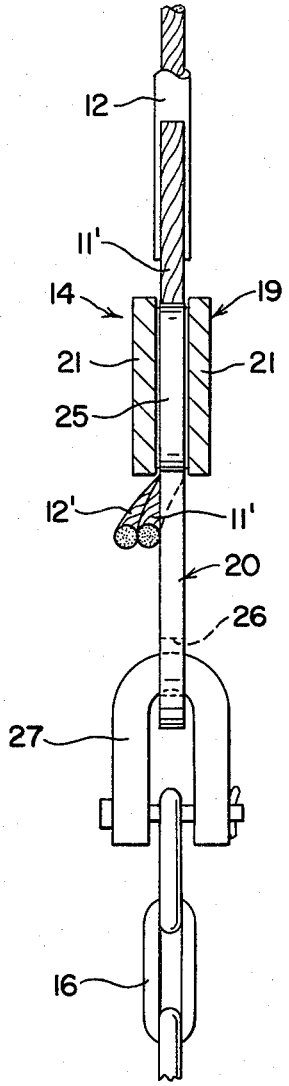
FIG. 2 is an enlarged partial view on line 2—2 of FIG. 1.

The improved hold-down system is shown in the drawings as applied to a membrane covering normally applied to a framework between bays of a building structure such as disclosed in U.S. Pat. No. 3,872,634. The membrane is indicated generally at 10 and the framework has been omitted for the sake of clarity. As shown in said patent the membrane is tensioned by means of catenary cables secured to the bottom edge of the membrane and the ends of the cables for adjoining bays are brought together and tied down at the base of the structure.

Two of the catenary cables are shown at 11 and 12 in the drawings, the cables preferbly having casings, and being secured along the curved bottom edges of the membrane 10. The improved tie-down system includes a cable retainer indicated generally at 14 which is connected under tension to the top of a foundation pier 15 by means of a chain 16. The piers 15 are preferably positioned around the sides of the concrete floor 17 of the structure.

The cable retainer 14 is an assembly of two interfitting parts, as shown in FIG. 5, the retainer sleeve 19 and the keeper plate 20. The retainer sleeve 19 preferably comprises two plates 21 secured in parallel spaced-apart relation by two bars 22 secured by welding within the side edges of the plates 21. The bars 22 are inclined downwardly inward, and the side edges of the plates preferably conform thereto. The upper and lower edges of the plates 21 are preferably parallel so that the configuration of the retainer sleeve is trapezoidal.

The keeper plate 20 is of a thickness which will slidably fit with the retainer sleeve 19 and has a wedge-shaped head or upper portion 24 with the side edges 25 thereof inclined or tapered downwardly inward at the same angle as the bars 22. The lower portion of plate 20 is a depending tongue having an aperture 26 at its lower end. The width of the upper portion 24 is such that when inserted into the center of the retainer sleeve 14 between the plates 19, the side edges 25 are spaced laterally inward of the bars 22 a distance substantially equal to two diameters of the cable end portions 11' and 12'.

As best shown in FIG. 4, the end portions 11' and 12' of cables 11 and 12 are stripped of their casings and looped in overlapping relation between the side edges 25 and the adjacent bars 22, down through one side and up through the other. As shown in FIG. 3, the plates 21 are spaced apart a distance slightly greater than the diameter of the stripped cable portions 11' and 12'. The width of the upper portion 24 of the keeper is such that when it is pulled downwardly within the sleeve 19 with the overlapping cable loops 11' and 12' therein, the overlapping cable portions 11' and 12' will be wedged side-by-side between the bars 22 and the side edges 25.

The keeper is detachably connected to the upper end of chain 16 preferably by means of a shackle yoke 27 and the lower end of the chain is connected preferably by means of a shackle yoke 28 to an anchor loop 29 embedded in the pier 15.

In the installation of the improved hold-down system, the stripped portions 11' and 12' of two contiguous cables 11 and 12 are looped through the retainer sleeve in overlapping relation and the keeper portion 24 is pulled downwardly between the loops to start wedging them against the bars 22. The lower end of keeper 20 is temporarily attached by means of a cable and hook (not shown) to one end of a ratchet and reel tensioning device (not shown), sometimes called a come-a-long, which is in turn connected by a cable (not shown) to the anchor loop 29. By manually reeling in and tensioning the attaching cable the keeper is pulled down and tension is transmitted to the catenary cables 11 and 12 to apply the required amount of tension to the membrane. The proper length of chain 16 is then connected between the keeper 20 and anchor loop 29 to maintain the required tension, whereupon the tensioning device may be removed and the operation repeated on two catenary cables at another bay intersection.

The improved hold-down system is simple and inexpensive to construct and install, and enables quickly connecting contiguous cables secured to the lower edges of the membrane covering to foundation anchor points. As shown in FIGS. 1 and 4, the free ends of the cable portions 11' and 12' are looped inside of the cables 11 and 12 emerging from the membrane 10, so that the ends are prevented from contacting closure curtains attached to and depending from the bottom curved edges of the main membrane. No sharp corners are presented by the cable retainer 14.

I claim:

1. A hold-down system for a tensioned membrane covering a rigid framework and having catenary cables secured to its lower edges between bays, comprising retainer means wedgably holding the end portions of two contiguous cables in overlapping loops, and flexible linear means detachably connected at one end to said retainer means and adapted at its other end for detachable connection to a foundation anchor.

2. A hold-down system as described in claim 1, wherein the retainer means comprises a retainer sleeve and a keeper slidable therein to wedgably engage said cable end portions.

3. A hold-down system as described in claim 2, wherein said linear means is detachably connected to said keeper.

4. A hold-down system as described in claim 3, wherein said retainer sleeve comprises two spaced-apart plates connected by inclined side bars, and said keeper comprises a flat plate having similarly inclined side edges.

5. A hold-down system as described in claim 4, wherein said retainer plates are spaced apart a distance substantially equal to the diameter of said cables.

6. A hold-down system as described in claim 5, wherein the side edges of said keeper plate when inserted in said retainer sleeve are spaced laterally from said side bars a distance of two cable diameters, so as to wedge the two cables in lateral side-by-side relation between the keeper and said side bars.

* * * * *